US006651318B2

(12) United States Patent
Buck et al.

(10) Patent No.: US 6,651,318 B2
(45) Date of Patent: Nov. 25, 2003

(54) METHOD OF MANUFACTURING FLEXIBLE INTERCONNECT CABLE

(75) Inventors: Arthur Buck, Sherwood, OR (US); Laurence A. Daane, Wilsonville, OR (US); Malai Hongthong, Woodburn, OR (US); Cindy Lee Diegel, Sherwood, OR (US)

(73) Assignee: Ludlow Company LP, Chicopee, MA (US)

( * ) Notice: Subject to any disclaimer, the term of this patent is extended or adjusted under 35 U.S.C. 154(b) by 0 days.

(21) Appl. No.: 10/186,525

(22) Filed: Jun. 28, 2002

(65) Prior Publication Data

US 2003/0000728 A1 Jan. 2, 2003

Related U.S. Application Data

(63) Continuation-in-part of application No. 09/822,550, filed on Mar. 30, 2001.

(51) Int. Cl.[7] ..... H01R 43/00

(52) U.S. Cl. ..... 29/825; 29/450; 29/451; 29/599; 156/56

(58) Field of Search ..... 29/599, 745, 450, 29/451, 825; 156/56

(56) References Cited

U.S. PATENT DOCUMENTS 4,487,641 A * 12/1984 Bohannon, Jr. et al.
4,506,430 A * 3/1985 Guzay, Jr.
4,568,401 A * 2/1986 Davis
4,761,519 A 8/1988 Olson et al.
4,767,891 A 8/1988 Biegon et al.
5,038,001 A 8/1991 Koegel et al.
5,373,619 A * 12/1994 Fleischhacker et al.
5,710,393 A 1/1998 Smith et al.
2002/0033271 A1 3/2002 Fritschle et al.

FOREIGN PATENT DOCUMENTS

| | | |
|---|---|---|
| EP | 0645780 A2 | 3/1993 |
| EP | 0778587 A2 | 6/1997 |
| GB | 2084811 | 4/1982 |
| JP | 4-301320 | 10/1992 |

* cited by examiner

*Primary Examiner*—Carl J. Arbes
(74) *Attorney, Agent, or Firm*—Langlotz Patent Works, Inc.; Bennet K. Langlotz

(57) ABSTRACT

A flexible interconnect cable is manufactured by a method that includes providing a core, and wrapping a conductive shield element about the core. An insulating sheath layer is extruded about the core to encompass the shield element, and a multi-wire cable component having ribbonized ends and detached intermediate portions is connected to an end of the core. The core is removed from the sheath to insert the cable component into the sheath. The resulting assembly has intermediate portions of the cable component that are loosely received within the shield and sheath.

10 Claims, 7 Drawing Sheets

METHOD OF MANUFACTURING FLEXIBLE INTERCONNECT CABLE

REFERENCE TO RELATED APPLICATION

This is a Continuation-In-Part of U.S. patent application Ser. No. 09/822,550, filed Mar. 30, 2001.

FIELD OF THE INVENTION

This invention relates to multiple wire cables, and more particularly to small gauge coaxial wiring.

BACKGROUND AND SUMMARY OF THE INVENTION

Certain demanding applications require miniaturized multi-wire cable assemblies. To avoid undesirably bulky cables when substantial numbers of conductors are required, very fine conductors are used. To limit electrical noise and interference, coaxial wires having shielding are used for the conductors. A dielectric sheath surrounds a central conductor, and electrically separates it from the conductive shielding. A bundle of such wires is surrounded by a conductive braided shield, and an outer protective sheath.

Some applications requiring many different conductors prefer that a cable be very flexible, supple, or "floppy." In an application such as a cable for connection to a medical ultrasound transducer, a stiff cable with even moderate resistance to flexing can make ultrasound imaging difficult. However, with conventional approaches to protectively sheathing cables, the bundle of wires may be undesirably rigid.

In addition, cable assemblies having a multitude of conductors may be time-consuming and expensive to assemble with other components. When individual wires are used in a bundle, one can not readily identify which wire end corresponds to a selected wire at the other end of the bundle, requiring tedious continuity testing. Normally, the wire ends at one end of the cable are connected to a component such as a connector or printed circuit board, and the connector or board is connected to a test facility that energizes each wire, one-at-a-time, so that an assembler can connect the identified wire end to the appropriate connection on a second connector or board.

A ribbon cable in which the wires are in a sequence that is preserved from one end of the cable to the other may address this particular problem. However, with all the wires of the ribbon welded together, they resist bending, creating an undesirably stiff cable. Moreover, a ribbon folded along multiple longitudinal fold lines may tend not to generate a compact cross section, undesirably increasing bulk, and may not provide a circular cross section desired in many applications.

The present invention overcomes the limitations of the prior art by providing a cable assembly and method of manufacturing. The method includes providing a core, and wrapping a conductive shield element about the core. An insulating sheath layer is extruded about the core to encompass the shield element, and a multi-wire cable component having ribbonized ends and detached intermediate portions is connected to an end of the core. The core is removed from the sheath to insert the cable component into the sheath. The resulting assembly has intermediate portions of the cable component that are loosely received within the shield and sheath.

DETAILED DESCRIPTION OF A PREFERRED EMBODIMENT

Figure 1:
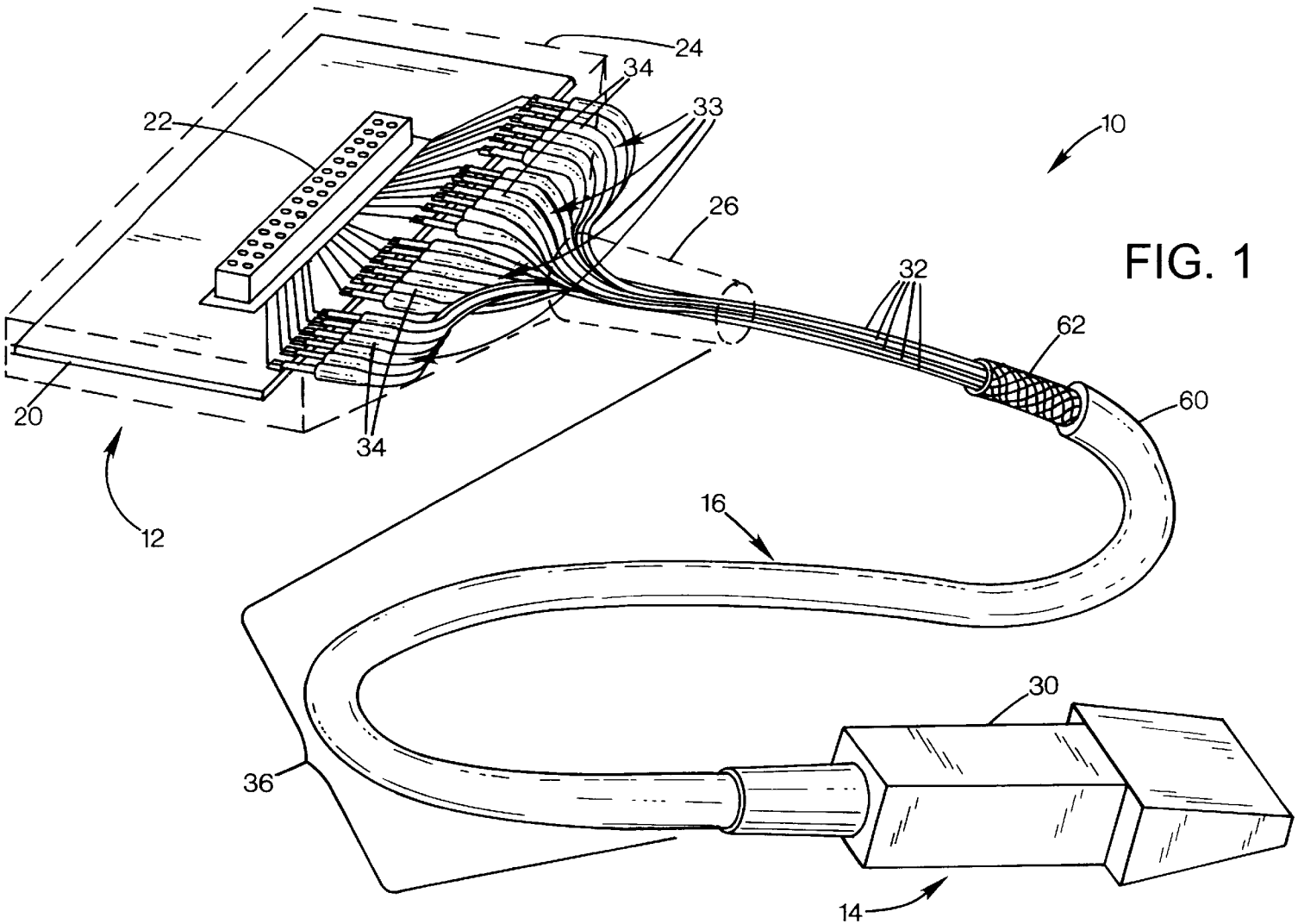
FIG. 1 is a perspective view of a cable assembly according to a preferred embodiment of the invention.

FIG. 1 shows a cable assembly 10 having a connector end 12, a transducer end 14, and a connecting flexible cable 16. The connector end and transducer ends are shown as examples of components that can be connected to the cable 16. In this example, the connector end includes a circuit board 20 with a connector 22 for connection to an electronic instrument such as an ultrasound imaging machine. The connector end includes a connector housing 24, and strain relief 26 that surrounds the end of the cable. On the opposite end, an ultrasound transducer 30 is connected to the cable.

Figure 2:
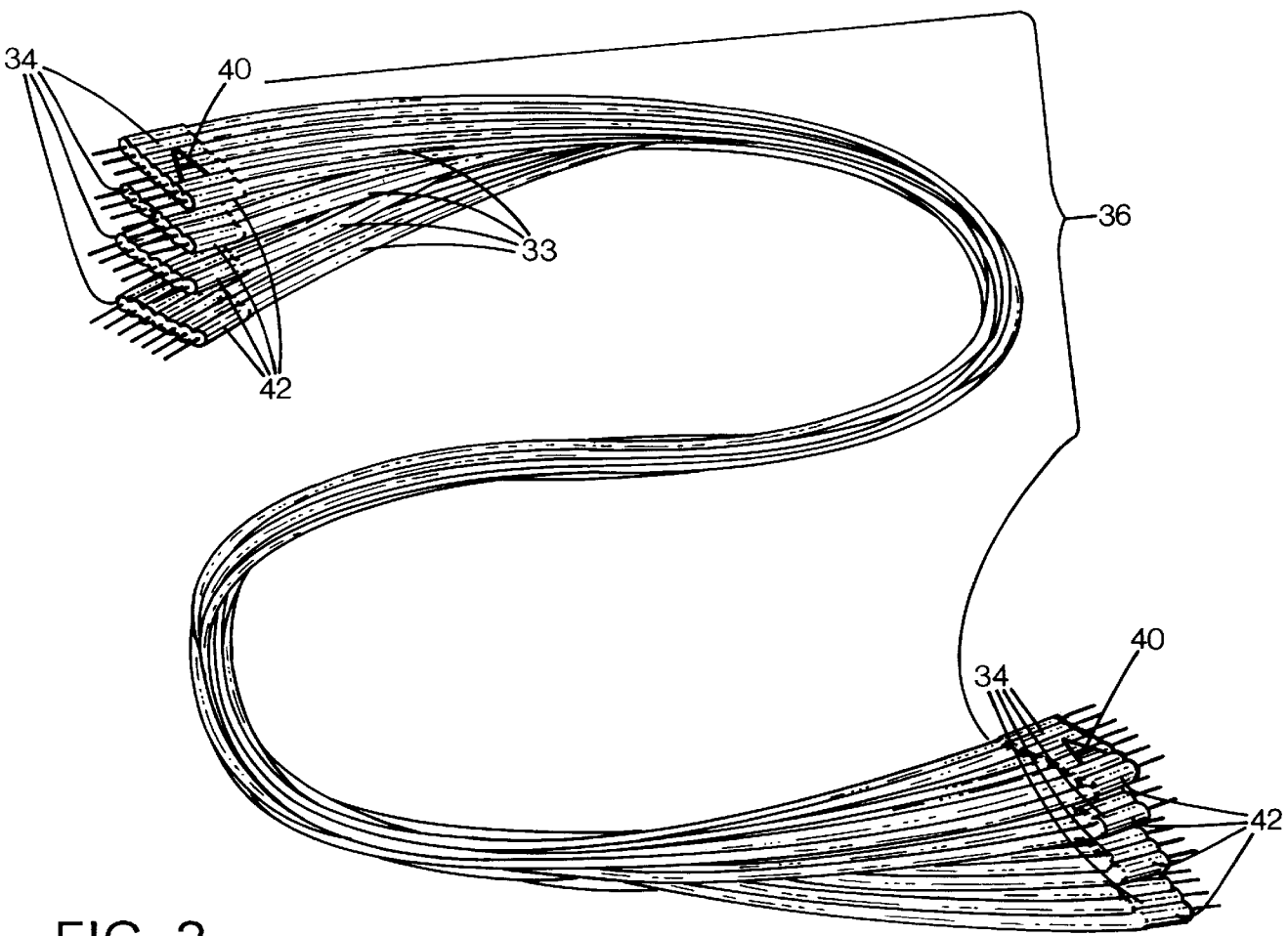
FIG. 2 is a perspective view of wiring components according to the embodiment of FIG. 1.

The cable 16 includes a multitude of fine coaxially shielded wires 32. As also shown in FIG. 2, the wires are arranged into groups 33, with each group having a ribbonized ribbon portion 34 at each end, and an elongated loose portion 36 between the ribbon portions and extending almost the entire length of the cable. Each ribbon portion includes a single layer of wires arranged side-by-side, adhered to each other, and trimmed to expose a shielding layer and center conductor for each wire. In the loose portion, the wires are unconnected to each other except at their ends.

The shielding and conductor of each wire are connected to the circuit board, or to any electronic component or connector by any conventional means, as dictated by the needs of the application for which the cable is used. The loose portions 36 of the wires extend the entire length of the cable between the strain reliefs, through the strain reliefs, and into the housing where the ribbon portions are laid out and connected.

The ribbon portions 34 are each marked with unique indicia to enable assemblers to correlate the opposite ribbon portions of a given group, and to correlate the ends of particular wires in each group. A group identifier 40 is imprinted on the ribbon portion, and a first wire identifier 42 on each ribbon portion assures that the first wire in the sequence of each ribbon is identified on each end. It is important that each group have a one-to-one correspondence in the sequence of wires in each ribbon portion. Consequently, an assembler can identify the nth wire from the identified first end wire of a given group "A" as corresponding to the nth wire at the opposite end ribbon portion, without the need for trial-and-error continuity testing to find the proper wire. This correspondence is ensured, even if the loose intermediate portions 36 of each group are allowed to move with respect to each other, or with the intermediate portions of other groups in the cable.

Figure 3:
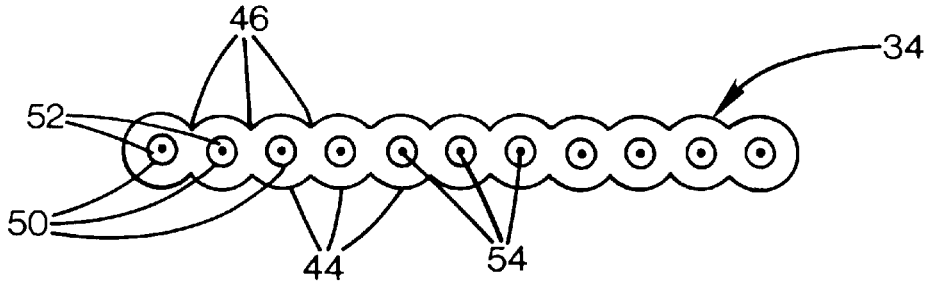
FIG. 3 is an enlarged sectional view of an end portion of a wiring component according to the embodiment of FIG. 1.

FIG. 3 shows a cross section of a representative end portion, with the wires connected together at their outer sheathing layers 44 at weld joints 46, while the conductive shielding 50 of each of the wires remains electrically isolated from the others, and the inner dielectric 52 and central conductors 54 remain intact and isolated. In alternative embodiments, the ribbon portions may be secured by the use of adhesive between abutting sheathing layers 44, by adhesion of each sheathing layer to a common strip or sheet, or by a mechanical clip.

Figure 4:
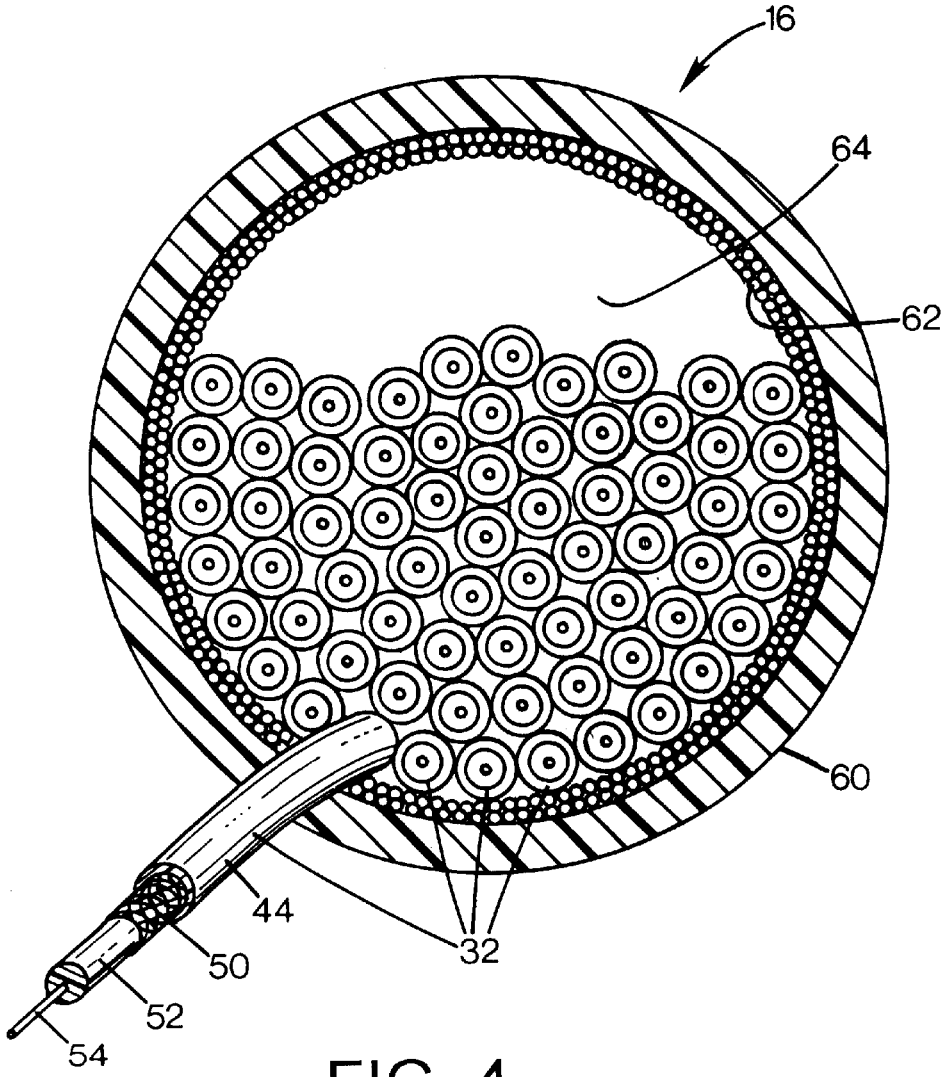
FIG. 4 is an enlarged sectional view of the cable assembly according to the embodiment of FIG. 1.
Figure 5:
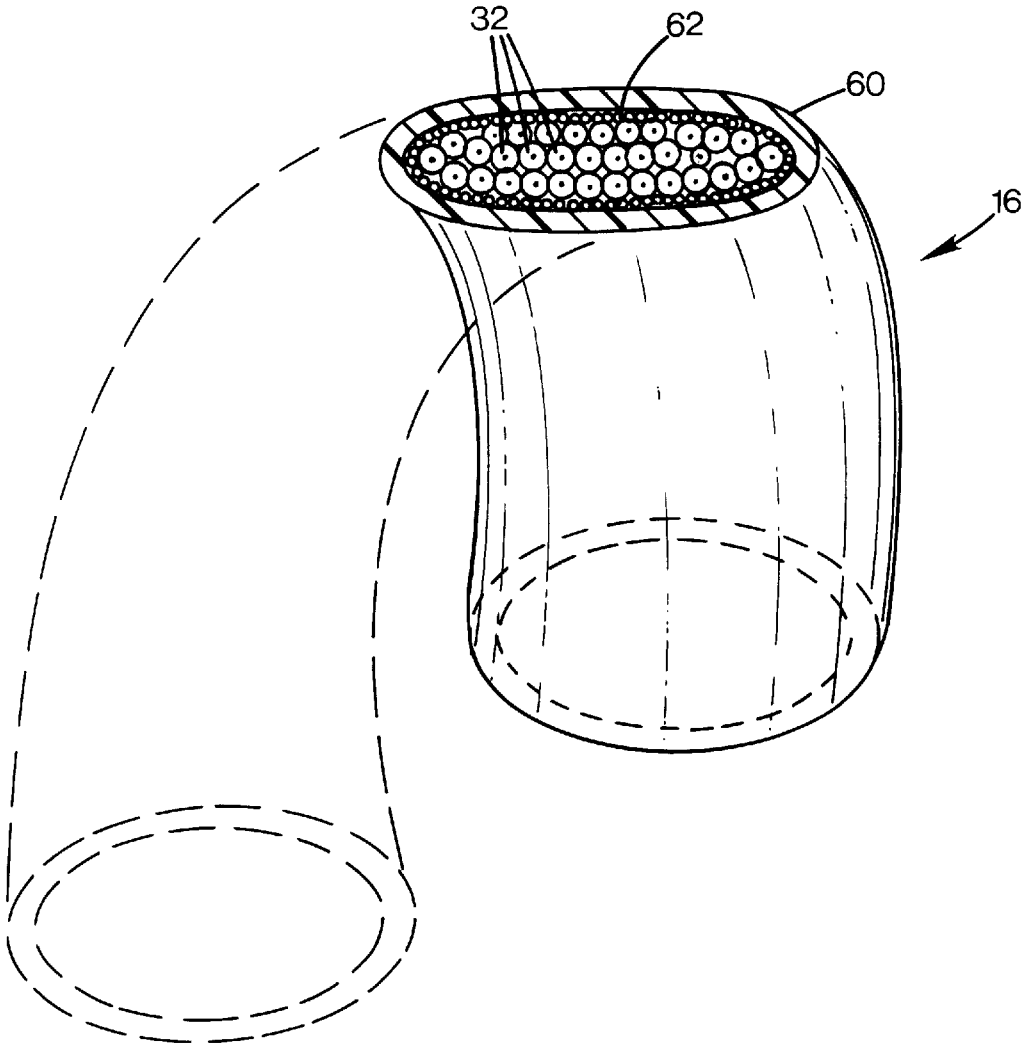
FIG. 5 is an enlarged sectional view of the cable assembly in a flexed condition according to the embodiment of FIG. 1.

FIG. 4 shows the cable cross section throughout most of the length of the cable, away from the ribbon portions, reflecting the intermediate portion. The wires are loosely contained within a flexible cylindrical cable sheath 60. As also shown in FIG. 1, a conductive braided shield 62 surrounds all the wires, and resides at the interior surface of the sheath to define a bore 64. Returning to FIG. 4, the bore diameter is selected to be somewhat larger than required to closely accommodate all the wires. This provides the ability for the cable to flex with minimal resistance to a tight bend, as shown in FIG. 5, as the wires are free to slide to a flattened configuration in which the bore cross section is reduced from the circular cross section it has when held straight, as in FIG. 4.

In the preferred embodiment, there are 8 groups of 16 wires each, although either of these numbers may vary substantially, and some embodiments may use all the wires in a single group. The wires preferably have an exterior diameter of 0.016 inch, although this and other dimensions may range to any size, depending on the application. The cable has an overall exterior diameter of the jacket portion 60 of 0.330 inch and the sheath has a bore diameter of 0.270 inch. As the loose wires tend to pack to a cross-sectional area only slightly greater than the sum of their areas, there is significant extra space in the bore in normal conditions. This allows the wires to slide about each other for flexibility, and minimizes wire-to-wire surface friction that would occur if the wires were tightly wrapped together, such as by conventional practices in which a wire shield is wrapped about a wire bundle. In the preferred embodiment, a bend radius of 0.75 inch , or about 2 times the cable diameter, is provided with minimal bending force, such as if the cable is folded between two fingers and allowed to bend to a natural radius. Essentially, the bend radius, and the supple lack of resistance to bending is limited by little more than the total bending resistance of each of the components. Because each wire is so thin, and has minimal resistance to bending at the radiuses on the scale of the cable diameter, the sum of the wire's resistances adds little to the bending resistance of the sheath and shield, which thus establish the total bending resistance.

Method of Manufacturing

Figure 6:
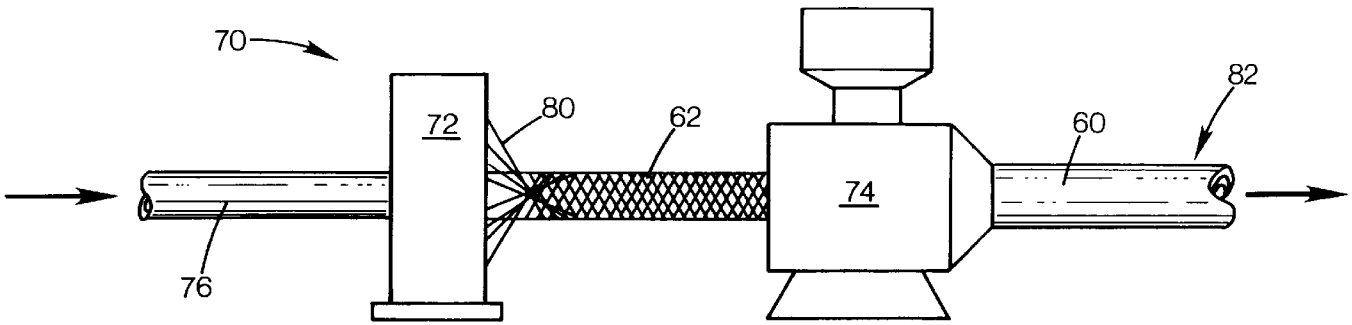
FIG. 6 is a simplified side view of a first process in a preferred method of manufacturing a cable assembly.
Figure 7A:
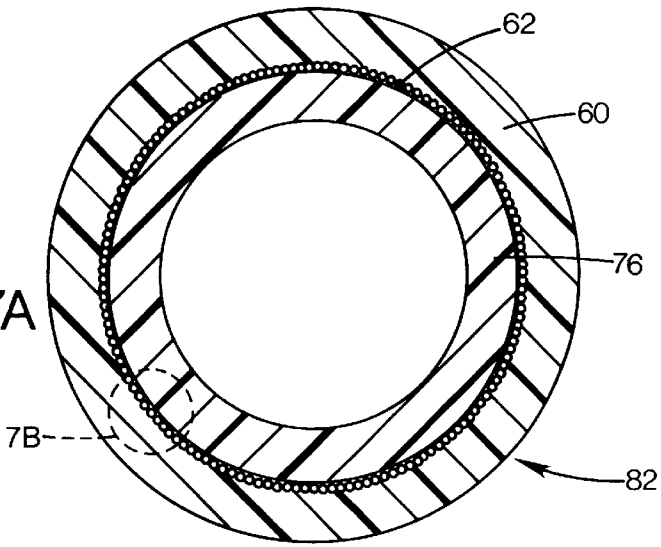
FIGS. 7A and 7B are a cross sectional views of a cable sheath component of the preferred embodiment of the invention.
Figure 7B:
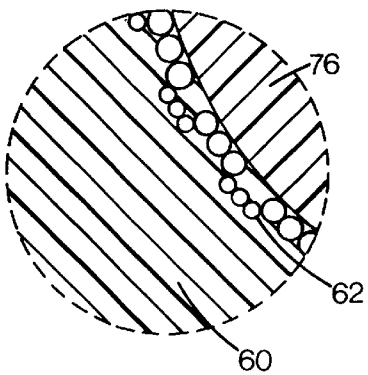

FIG. 6 shows a sheath manufacturing facility 70 including a shield braiding or weaving machine 72 and an extruder 74. A nylon core tube 76 with a smooth exterior surface with a diameter of 0.250 inch has a bore diameter of 0.200 inch. The core tube may be of any of a wide range of alternative materials, and may have a solid core. The tube is fed into the braiding machine, which wraps fine conductive metal strands 80 about the tube to form the shield 62. Thus wrapped, the shielded core is fed into the extruder 74, which extrudes the sheath 60 about the shielded core tube to form a resulting sheath component 82, which is shown in cross section in FIGS. 7A and 7B. In the preferred embodiment, the sheath material is flexible PVC, with alternative materials including thermoplastic elastomer, or polyurethane. The shield is extruded at a limited low temperature so that the sheath material maintains viscosity, does not excessively penetrate the pores or gaps between shield wires, and does not appreciably contact the core, except as minimally shown in FIG. 7B. This avoids adhesion that would make core tube extraction difficult. The sheath material partly encapsulates some of the shield wires, by at least partly encompassing them, and in selected embodiments, penetrating through interstices between the wires to contact or approach the surface of the core.

Nonetheless, the sheath material at least partly encapsulates the shield wires, generating adhesion that helps to maintain the shield and sheath interior in contact with each other throughout the length, without detaching during manufacture, assembly, or use of the cable. Consequently, the shield wires do not fall away from the sheath, but remain adhered along the entire length. This provides elastic resistance to tension, and facilitates restoration of its original length when tension is removed. The shield wires provide an elongation limit as they fully compress about the wires within to resist increasing tension, after which the elasticity of the sheath returns the shield to its original length and diameter about the wires within to provide the desired flexibility as discussed above. In some applications, these functions and benefits may be achieved if the shield detaches from the sheath, as long as the sheath is loose with respect to the cable wires, and remains attached to the sheath at each end.

Figure 8:
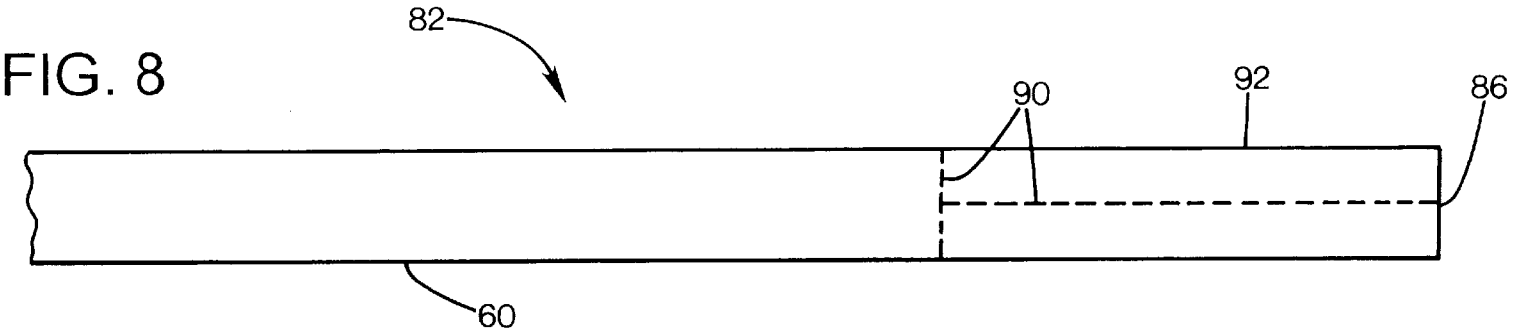
FIG. 8 is a side view of a cable assembly in a selected stage of manufacturing according to the method of claim 6.
Figure 9:
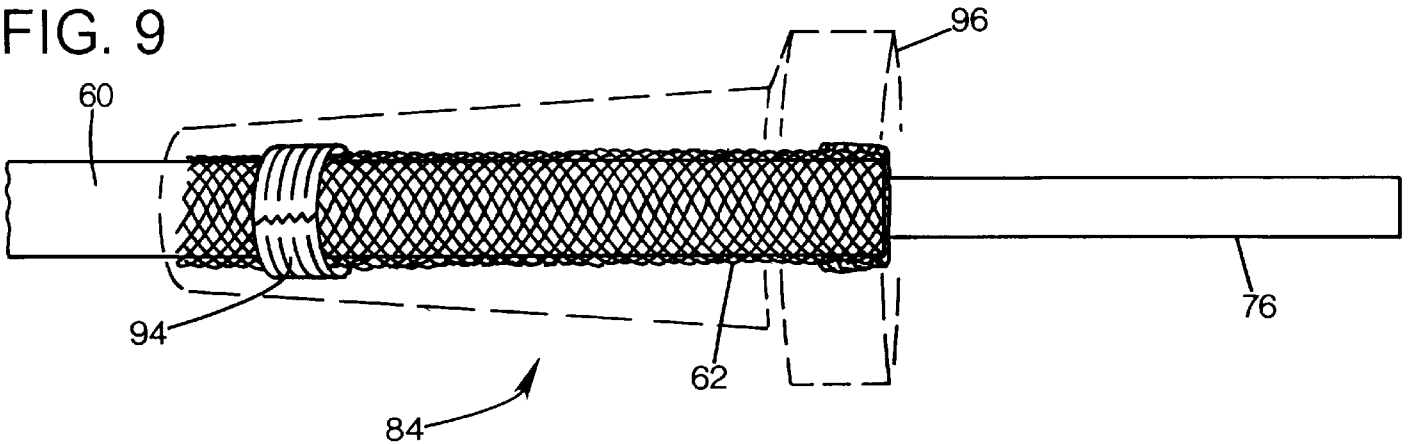
FIG. 9 is a side view of a cable assembly in a selected stage of manufacturing according to the method of claim 6.

FIG. 8 shows the sheath segment 82 (which includes the core, shield, and sheath) cut to provide an end 86. An opposed end (not shown) is similarly cut. The sheath layer is cut on lines 90 for removal of an end portion 92 comprising about 6 inches of the segment on each end, while leaving the shield wires and core intact. As shown in FIG. 9, the end portion is removed, and the shield wires 62 are folded back into a cylindrical shape against the exterior of the sheath 60, and secured at the end by a band of adhesive tape 94. At this stage, the ends of the shield may optionally be secured to the sheath by attachment of a strain relief element 96. The strain relief element may be an over-molded elastomer that covers the folded back portion of the shield wires, or may be a rigid clamping type device that pinches the shield and sheath end in an annular gap or nip. Even without the strain relief element, the folded-back shield end resists dislodgment from the sheath by axial tension forces from the opposite end.

Figure 10:
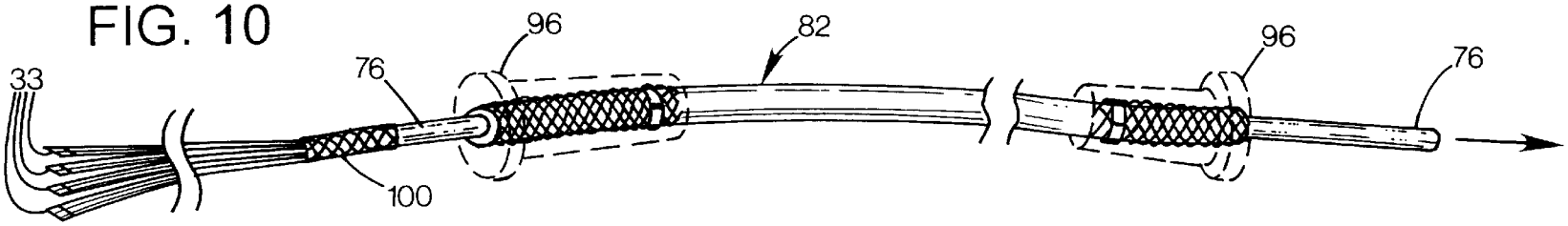
FIG. 10 is a side view of a cable assembly in a selected stage of manufacturing according to the method of claim 6.
Figure 11:
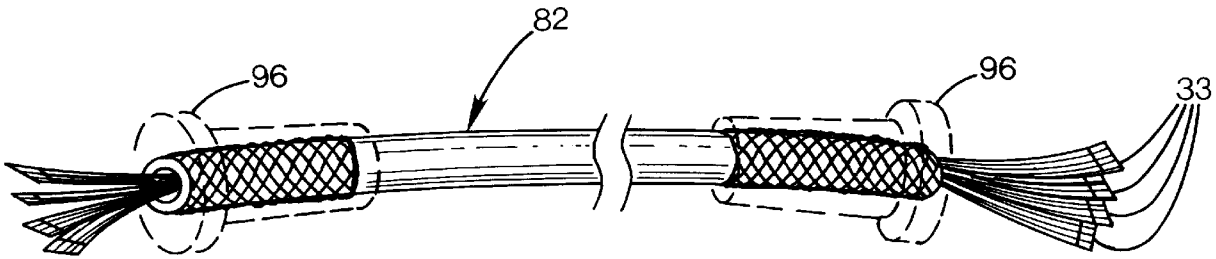
FIG. 11 is a side view of a cable assembly after manufacturing according to the method of claim 6.

As shown in FIG. 10, the cable ribbons 33 are connected at their ends to an end of the core 76 by a woven sheath 100 that collapses about its contents as tension is applied. Alternative embodiment such as clips, tape, or other hooks may be employed, as long as they are slim enough to readily pass through the bore of the sheath, and to protect the ribbonized ends of the wires as the pass through the sheath, all without damaging the shielding in the sheath. The core 76 is pulled from the end opposite the connected ribbons 33, until an approximately equal length of cable is exposed at each end of the sheath, and the core is detached from the ribbons, as shown in FIG. 11, which shows the resulting cable component. The cable component has ribbonized ends exposed at each end, and indicia identifying each group at each end, and the first wire in each group for subsequent operations. The wires are laser stripped to expose the central conductors and shielding in each wire, enabling connection to connectors of circuit elements as discussed above.

In alternative embodiments, the strain reliefs may be added after ribbon insertion, and the folded back shield wires may be trimmed. In some embodiments, the shield wires may be effectively adhered to the sheath interior during the sheath extrusion, so that folding back and end taping is not needed to prevent the shield from slipping out or necking down during ribbon insertion. In other embodiments, the shield may be loose or readily separable from the sheath interior, necessitating the illustrated folding back of the shield ends.

While the above is discussed in terms of preferred and alternative embodiments, the invention is not intended to be so limited.

We claim:

1. A method of manufacturing a cable assembly comprising:

providing an core;

wrapping a conductive shield, element about the core;

forming a sheath by applying an insulating sheath layer to encompass the shield element;

removing the core from the sheath; and inserting a multi-wire cable component into the sheath.

2. The method of claim 1 wherein the core is a smooth plastic cylinder.

3. The method of claim 1 wherein wrapping a conductive shield includes wrapping a plurality of wires about the core.

4. The method of claim 1 including the step of attaching the cable component to the core before removing the core from the sheath.

5. The method of claim 1 including removing an end portion of the sheath layer and folding an exposed end portion of the shield back upon the remaining sheath layer before removing the core.

6. The method of claim 1 including attaching a strain relief element to an end portion of the sheath before removing the core.

7. The method of claim 1 wherein the cable component comprises a plurality of wires ribbonized at their ends and having intermediate portions between the first and second ends detached from each other.

8. A method of manufacturing a cable assembly comprising:

providing an core;

wrapping a conductive shield element about the core;

extruding an insulating sheath layer to encompass the shield element;

attaching a multi-wire cable component having ribbonized ends and detached intermediate portions to an end of the core; and removing the core from the sheath to insert the cable component into the sheath.

9. The method of claim 8 including removing an end portion of the sheath layer and folding an exposed end portion of the shield back upon the remaining sheath layer before removing the core.

10. The method of claim 8 including attaching a plurality of multi-wire cable components having ribbonized ends and detached intermediate portions to an end of the core.

* * * * *